US009205958B2

(12) United States Patent
Cook

(10) Patent No.: US 9,205,958 B2
(45) Date of Patent: Dec. 8, 2015

(54) CONVERSION OF EXISTING OPEN TOP CONTAINER TO RECLOSABLE CAN

(75) Inventor: Steven T. Cook, Miamisburg, OH (US)

(73) Assignee: DAYTON SYSTEMS GROUP, INC., Miamisburg, OH (US)

( * ) Notice: Subject to any disclaimer, the term of this patent is extended or adjusted under 35 U.S.C. 154(b) by 687 days.

(21) Appl. No.: 13/389,489

(22) PCT Filed: Aug. 10, 2010

(86) PCT No.: PCT/US2010/045034
§ 371 (c)(1),
(2), (4) Date: Jun. 25, 2012

(87) PCT Pub. No.: WO2011/019728
PCT Pub. Date: Feb. 17, 2011

(65) Prior Publication Data

US 2012/0255927 A1 Oct. 11, 2012

Related U.S. Application Data

(60) Provisional application No. 61/232,698, filed on Aug. 10, 2009.

(51) Int. Cl.

| | |
|---|---|
| ***B65D 41/06*** | (2006.01) |
| ***B65D 1/16*** | (2006.01) |
| ***B21D 22/28*** | (2006.01) |
| ***B21D 51/26*** | (2006.01) |
| ***B65D 79/00*** | (2006.01) |

(52) U.S. Cl.
CPC ..... *B65D 41/06* (2013.01); *B21D 22/28* (2013.01); *B21D 51/26* (2013.01); *B65D 1/165* (2013.01); *B65D 79/005* (2013.01)

(58) Field of Classification Search
CPC ..... B65D 1/165; B65D 1/0245; B65D 7/04; B65D 41/06; B65D 41/065; Y10T 29/49716
USPC ..... 29/401.1; 72/334, 330, 327
See application file for complete search history.

(56) References Cited

U.S. PATENT DOCUMENTS

| | | | | |
|---|---|---|---|---|
| 2,359,775 | A * | 10/1944 | McManus et al. | 72/47 |
| 3,952,677 | A | 4/1976 | Hartman et al. | |
| 4,341,103 | A | 7/1982 | Escallon et al. | |
| 5,048,171 | A * | 9/1991 | Bidwell et al. | 29/401.1 |
| 6,082,944 | A | 7/2000 | Bachmann et al. | |
| 6,463,776 | B1 * | 10/2002 | Enoki et al. | 72/46 |
| 2006/0011633 | A1 | 1/2006 | Cook et al. | |

FOREIGN PATENT DOCUMENTS

| | | | |
|---|---|---|---|
| JP | 1990 133116 | A | 5/1990 |
| JP | 2002 292434 | A | 10/2002 |
| JP | 2007 331813 | A | 12/2007 |

OTHER PUBLICATIONS

PCT/US2010/045034 International Search Report.
EP 10 80 8635, Supplementary European Search Report, mailed Jul. 6, 2015.

* cited by examiner

*Primary Examiner* — Jason L Vaughan
(74) *Attorney, Agent, or Firm* — Fay Sharpe LLP

(57) ABSTRACT

A can or container reformed from an existing open ended can adds additional volume and integral thread portions to form a reclosable can. An existing can is inverted, drawn to increase the volume, an end wall pierced and reformed into an outwardly curled lip, thread portions formed along a perimeter portion of the can body adjacent a first end, and a new end seamed to the original open, second end of the can. A cap with thread lugs cooperates with the thread portions on the external perimeter of the reformed can to originally and subsequently reseal the can once the can has been opened.

17 Claims, 2 Drawing Sheets

CONVERSION OF EXISTING OPEN TOP CONTAINER TO RECLOSABLE CAN

This application is a national filing of international application number PCT/US2010/045034, filed 10 Aug. 2010, which claims the priority benefit of U.S. provisional application Ser. No. 61/232,698, filed 10 Aug. 2009.

BACKGROUND OF THE DISCLOSURE

Commonly owned U.S. Pat. Nos. 6,015,062; 7,069,763; 7,370,507 and published application US2006-0011633 and disclose containers/cans and caps therefor, tooling for making the can bodies and caps, and the method or processes of making cans that employ a reclosable cap. The disclosure of each of these U.S. patents and published applications is incorporated herein by reference. Heretofore, this technology has been used to manufacture new can bodies and oftentimes includes the manufacture of a separate dome that is connected or seamed to the open end of a main can body. The dome in an exemplary arrangement typically has a conical tapering conformation that narrows to an opening that receives a removable cap. To retain the cap in closed relation with the opening, external thread portions are provided adjacent one end of the dome about an outer periphery of the opening. These thread portions are selectively engaged by thread lugs that extend from an inner peripheral portion of a cap rim to draw a cap into sealed, reclosable engagement with the periphery of the opening. In other instances, the thread lugs are formed on an outer peripheral portion adjacent the open end of a can body which may not be tapered. The thread portions are still adapted to receive the corresponding thread lugs of a reclosable cap.

In the food and beverage can industry, for example, open ended can bodies having a bottom wall that is integrally formed with the side wall. A blank of material is punched from a cold-rolled sheet and initially formed into a cup that has an end with integral sidewall. The cup is subsequently formed or ironed with dies and forming machinery to shape the metal and form a can body into an open-top can. An open or upper, second end is subsequently closed with a separately formed lid or end panel. The end is connected along a peripheral portion to the open-ended sidewall of the can body via a crimp or seam. Typically, the ends are seamed to the open end of the can body and the consumer accesses the contents of the can by (i) removing the end with a can opener, (ii) removing or tearing away the end via a pull tab, or (iii) an easy-open, retained scored region or panel portion in the end that is opened with a retained tab.

There are times, however, where the entire contents of the food or beverage container, for example, may not be used. The consumer must then empty the entire contents from the can since there is no effective way to close and seal the can for future use once the can has been opened. Likewise, these cans are made time and again at the same volume and do not easily lend themselves to converting to new sizes of containers without a significant capital investment in equipment.

Therefore, a need exists for providing a reclosable can, particularly in the metal food container industry. There is also a desire to accomplish this goal without adding additional metal to the container, while advantageously providing additional volume.

SUMMARY OF THE DISCLOSURE

A method of forming a reclosable can from an open ended container is provided.

A preferred method includes providing a container having a closed first end spaced from an open second end with an integral sidewall extending between the first and second ends. Drawing the first end enlarges the can body to a second height/volume greater than an original, first height/volume and forming neck thread portions on the sidewall prepares the can to be reclosable.

The drawing step includes reducing a diameter of the sidewall to a reduced diameter relative to a remainder of the sidewall during the drawing step.

The process further includes redrawing the sidewall subsequent to the drawing step to further increase the height or enlarge the enclosed volume, and preferably by further reducing the reduced diameter to a second reduced diameter portion separated from the first reduced portion by a step.

Subsequently, the first end is removed from the drawn body whereby the sidewall is open at both the first and second ends.

Next, the open first end is curled to provide an outwardly curled lip around the new opening.

The method includes forming thread portions on a peripheral portion of the sidewall adjacent the first end.

The method includes seaming a new end on the second end of the container.

A container with an increased height and preferably enlarged volume is provided, and advantageously includes a reclosable arrangement.

A primary advantage of the present disclosure is the ability to convert an existing open ended container into a reclosable can body with integral thread portions.

Another benefit resides in the ability to increase the height/volume of the can body.

Yet another advantage is associated with an enlarged volume without requiring additional metal while providing a reclosable end.

Still other advantages and benefits of the present disclosure will become more apparent upon reading and understanding the following detailed description.

DETAILED DESCRIPTION OF THE PREFERRED EMBODIMENTS

Figures 1, 2, 3, 4, 5, 6, 7, 8:
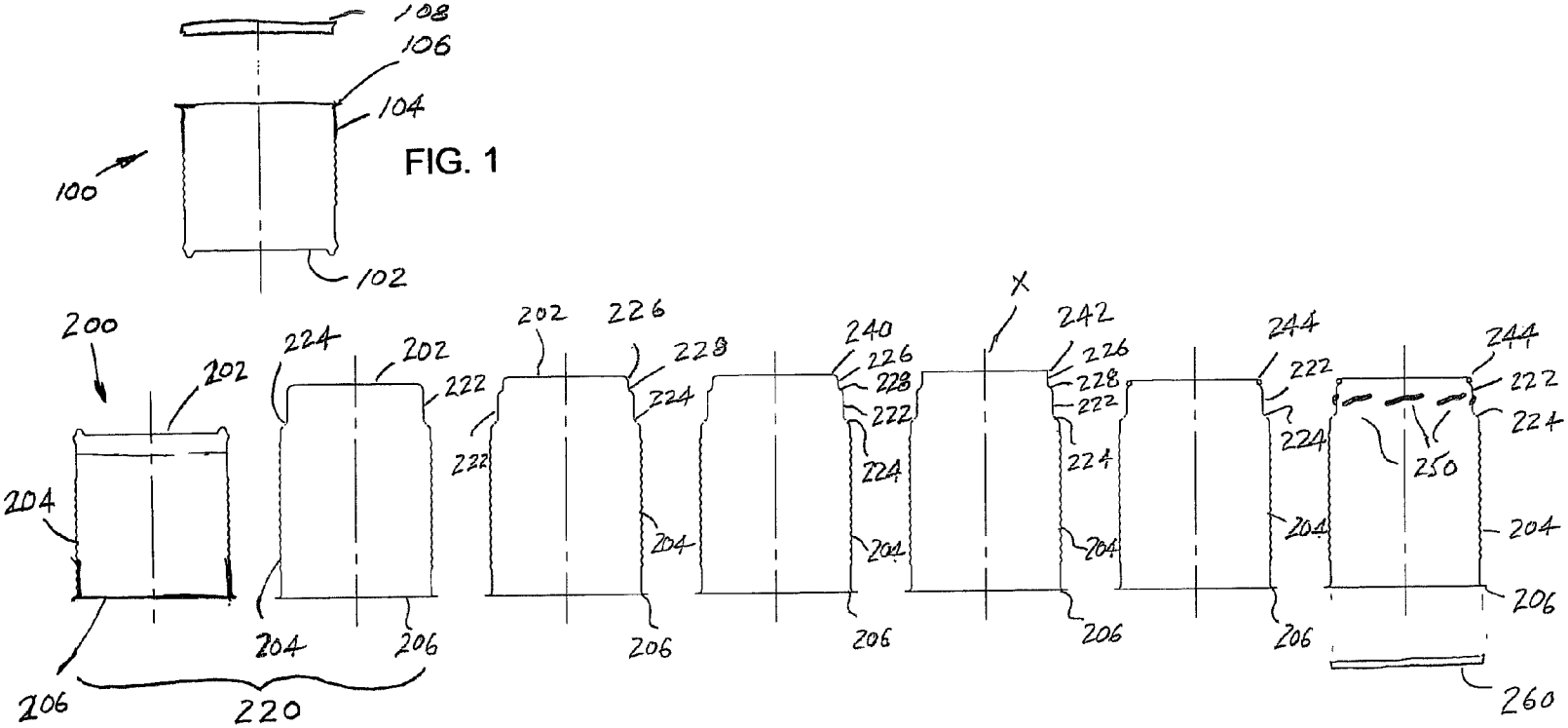
FIG. 1 is a longitudinal cross-sectional view of a conventional can with an integral end and open end closed by a seamed end.
FIG. 2 shows a longitudinal cross-sectional view of the can of FIG. 1 with the seamed end removed and the can in an inverted position.
FIG. 3 shows the results of the draw process or step completed in a first station.
FIG. 4 is a longitudinal cross-sectional view after passing through a neck station.
FIG. 5 is a longitudinal cross-sectional view of the can after before exiting the pierce station.
FIG. 6 is a longitudinal cross-sectional view after the wipe-up station.
FIG. 7 is a longitudinal cross-sectional view of the container after the curl station.
FIG. 8 represents the converted container after the thread station.

FIG. 1 shows a conventional can or container 100 having a first or lower end 102 integral with a sidewall 104 and an open second or upper end 106. By the term integral, one skilled in the art will understand that the material (aluminum or tin plated steel, for example) has no seams or welds along the sidewall and first end. The sidewall and integral end are one-piece and formed from the same material—typically in a D and I process (drawing and wall ironing process). The open-ended substantially cylindrical can body is closed by an end panel 108 seamed about its outer periphery to the second end 106 of the container. The integral first end is often shaped in a reverse curve formation (inwardly extending dome, for example) to add strength to the can body For example, this type of conventional can is used in a wide variety of food or beverage containers (although the present disclosure should not be limited to these end uses) and requires a can opener, pull tab, or integral tab with score for example to separate a portion of the end panel 108 from the upper end 106 of the can.

Shown in FIG. 2 is an inverted can or container of the type shown in FIG. 1 having the integral first end but without the seamed end panel 108. The inverted can is located in a fixture (not shown) for a series of progressive dome forming steps that increase the volume and add thread portions to a periphery of the re-formed can, a new end seamed thereon, and a reclosable cap provided for cooperation with the thread portions. Particularly, since the container is inverted, like reference numerals in the "200" series will refer to the can/container during the conversion process, while new numerals will refer to new components. Can or container 200 has a first end 202 integral with the sidewall 204 and an open second end 206. Other than being in an inverted condition, this can is typically manufactured by a third party or manufactured within the plant of a food industry supplier, for example. It will also be appreciated that although the can is shown in an inverted state, the actual conversion or forming process need not be performed in this particular orientation.

By comparing FIGS. 2 and 3, the results of the drawing step 220 conducted in a first station of the associated tooling (not shown) are shown, specifically illustrating a first height and enclosed volume of the can of FIG. 2 relative to an increased height and increased enclosed second volume defined by the end 202 and sidewall 204 after the drawing process. No additional metal is required to achieve the increase in height and enclosed volume. Rather, first end 202 is drawn relative to the second end 206 and a substantial portion of the sidewall 204 retains its original diameter (since the can body is supported internally by a support member or horn (not shown) during the drawing process. The drawing operation preferably does not substantially affect the thickness of the sidewall 204, i.e., there may be some stretching of the material of the sidewall and integral end, but there is no significant reduction in thickness of the sidewall. Rather, the reverse curved conformation of the first end wall 202 relative to the sidewall 204 as shown in FIG. 2 is altered (i.e., the radius is reversed) in FIG. 3 as a result of the draw process. The drawn region adjacent the first end 202 has a first reduced diameter 222 that is separated from the remainder of the sidewall 204 by a first step 224. The step 224 is also indicative of the location of he clamp during the drawing process (and the draw clamp will typically have a conformation that is the mirror image of the shoulder/step 224 and the first reduced diameter 222). The overall height of the can increases on the order of 0.75 to 1.0 inches for example in a can that was originally approximately 3.0 inches in height, and likewise the volume increases substantially as a result of the first or draw station. Of course, different sized containers will experience different increases in height and volume. One skilled in the art will also recognize that the increase in volume is not directly proportional to the increased height since the diameter of the can in the drawn region 222 is slightly reduced during the drawing process, however, a significant increase in can volume is still achieved with the same amount of metal. Likewise, further drawing steps or operations can be performed if so desired to further increase the height and volume.

In FIG. 4, a second or further reduced diameter 226 is separated from the first reduced diameter portion 222 by a second step 228 as a result of the tooling in a second or neck forming station. This neck forming operation adds slightly increased length and volume to the reformed can. However, as will be appreciated most of this additional volume is not maintained in the final structure.

The integral first end 202 is removed in a third or pierce station shown in FIG. 5. Any conventional manner of physically removing the end 202 may be used, such as a punch and die operation in a press leaving a terminal edge 240 about an inner perimeter of the second reduced diameter 226. As shown in FIG. 5, the terminal edge 240 extends slightly radially inwardly since the piercing operation does not leave a straight edge.

Thus, in FIG. 6 the terminal edge is straightened or wiped-up as shown so that the terminal edge extends in a generally parallel direction with longitudinal axis "X" of the can. This fourth or wipe-up station prepares the terminal edge 240 for a lip curling procedure represented in a fifth or curl station of FIG. 7, where the wiped edge 242 is deformed or rotated radially outward to form an outwardly curled edge 244. The outwardly curled edge is desired since the curled edge permits the cap (to be described below) to seal along an outer perimeter edge and protect the product in the can from potential contamination.

Shown in FIG. 8 are individual thread portions 250 spaced at perimeter locations along the first reduced diameter portion 222. The thread portions are preferably of the type shown and described in U.S. published application US2006-0011633, previously incorporated herein by reference, or may be of other external thread portions provided about the periphery of the can body. The thread portions permit the integral cap to be held in place under a pressurized state in a first rotational position of the cap relative to the can body, moved to a land portion of the thread portions 250 where the cap is still retained but the pressure released in a second rotational position of the cap relative to the can body, and subsequently moved to a third region of the thread portions 250 in a third rotational position of the can body where the entire cap can be axially removed from the can body (removed in a direction generally parallel to the X axis).

Formation of the thread portions is also advantageously completed from the first end of the can. In other words, the thread forming tooling is fixed relative to the outward curl 244 and preferably enters the can body through the opening formed by the piercing operation. As a result, the height of the thread portions on the can body are precisely located and fixed relative to the outward curl so that cooperation with thread lugs provided on the cap (to be described below) is closely controlled and thereby provides a repeatable, quality seal between the cap and can body that holds pressure or negative pressure.

Also represented in FIG. 8 is an end panel 260 that is seamed about a perimeter to the second end 206 of the reformed can 200. The seaming operation is a conventional process so that further description is deemed unnecessary to a full and complete understanding of the present disclosure.

Figure 9:
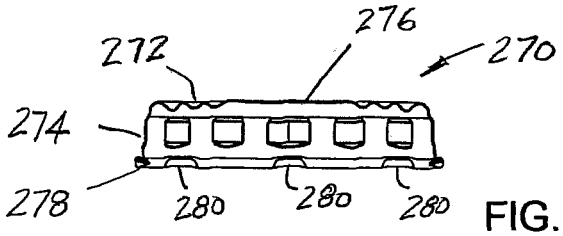
FIG. 9 is an elevational view of a preferred form of lugged cap.
Figure 10:
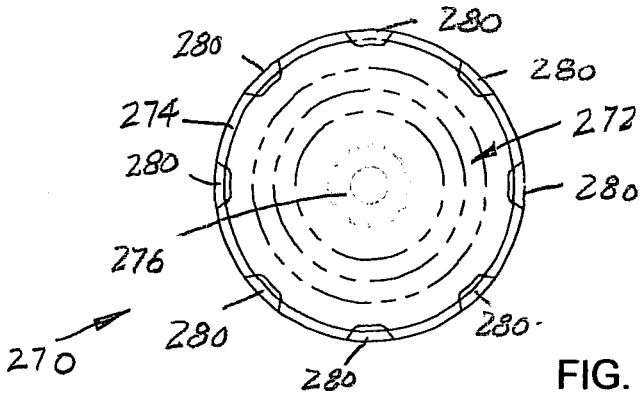
FIG. 10 is a bottom plan view of the lugged cap of FIG. 9.

A cap 270, shown in FIGS. 9 and 10, includes an end wall 272 and an integral sidewall 274. The end wall 272 may include a pressure button 276, preferably in a central portion thereof, that serves as a tamper evident feature. If the contents of the can are placed under positive pressure, the central panel portion or pressure button 276 deflects downwardly and makes an audible click or sound upon release of pressure from the pressurized can. Likewise, if the can is placed under a negative pressure or vacuum, the central panel portion may deflect upwardly, again with an audible click, representing the loss of negative pressure in the can.

Figure 11:
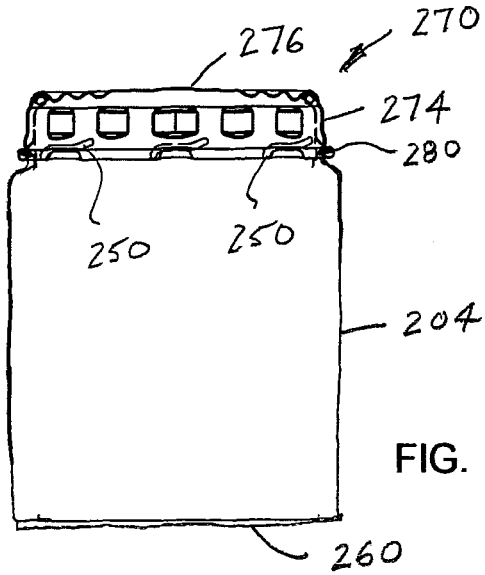
FIG. 11 is an elevational view of the reformed can with the lugged cap shown in phantom in a closed position.

Extending radially inward from a lower curled edge 278 of the cap sidewall are lugs 280 that are spaced about the periphery thereof. The circumferentially spaced lugs 280 cooperate with the thread portions 250 of the can body to secure the cap, and particularly the end wall and an inner surface of the cap. The cap may include a seal member or seal coating in selective sealing engagement with the curled edge 244 of the can. The sealed position of the cap on the can body is best illustrated in FIG. 11 where the cap is held in place on the can by the lugs seated beneath the horizontally extending land portions of the thread portions 250.

The ability to convert an existing can as described above allows a can manufacturer to use existing can making equipment and add the above described stations in-line. The resultant converted can does not have any sharp edges, can be filled in-line, adds significant volume to the can, and provides a reclosable can that adds the minimal cost of a cap to achieve significantly improved functionality.

The disclosure has been described with reference to the preferred embodiments. Modifications and alterations will occur to others upon reading and understanding this specification. It is intended to include all such modifications and alterations in so far as they come within the scope of the appended claims or the equivalents thereof.

Having thus described the invention, I claim:

1. A method of forming a reclosable can from an open-ended container comprising:

providing a container having a closed first end with an integral sidewall extending a first height from the first end, the container having a second end closed by an end panel;

removing the end panel from the second end;

enlarging the can body to a second height between the first and second ends;

removing the first end from the enlarged can body to form an opening therein; and forming neck thread portions on the sidewall at the first end for threadably receiving a reclosable cap on the first end.

2. The method of claim 1 wherein the drawing step includes initially drawing the first end at a substantially constant diameter from the first height to the greater second height.

3. The method of claim 2 wherein the drawing step is along the sidewall adjacent the first end and a remainder of the sidewall extending to the second end remains at a substantially constant diameter.

4. The method of claim 3 wherein the drawing step includes reducing a diameter of the sidewall to a reduced diameter relative to the remainder of the sidewall with a first step defined therebetween.

5. The method of claim 4 further comprising redrawing the sidewall subsequent to the drawing step to further enlarge the height of the can.

6. The method of claim 5 wherein the redrawing step includes further reducing the reduced diameter to a second reduced diameter portion that is separated from the first reduced portion by a second step.

7. The method of claim 6 further comprising shaping the sidewall along the first and second reduced diameter portions.

8. The method of claim 7 wherein further comprising forming thread portions in a peripheral portion of the sidewall adjacent the first end.

9. The method of claim 8 wherein the thread forming step is located in the first reduced diameter portion of the sidewall.

10. The method of claim 9 further comprising forming the second reduced diameter portion of the sidewall into a curl.

11. The method of claim 10 wherein the curl forming step includes rotating the second reduced diameter portion outwardly.

12. The method of claim 11 wherein the drawing and redrawing steps increase the height approximately 30%.

13. The method of claim 1 further comprising:

clamping about a periphery of the sidewall adjacent the first end and drawing the first end and sidewall to an extended length having a first reduced diameter portion;

forming the first end and sidewall to a further extended length having a second reduced diameter portion at a terminal edge less than the first reduced diameter portion;

curling the terminal edge and second reduced diameter portion radially outward;

forming thread portions about a periphery of the first reduced diameter portion; and seaming a separate end to the second end.

14. The method of claim 13 further comprising wiping the terminal edge of the second reduced diameter portion prior to the curling step.

15. The method of claim 13 wherein the drawing and forming increases a height of the can relative to an original height of the can approximately 30%.

16. The method of claim 13 wherein the material of the can is tin plate steel.

17. The method of claim 1 wherein the enlarging step includes drawing the first end to increase the height between the first and second ends.

* * * * *